United States Patent [19]

Mersek et al.

[11] 4,192,172

[45] Mar. 11, 1980

[54] FORGING MACHINE TRANSFER FOR HEAVY WORKPIECES

[75] Inventors: Leo D. Mersek, Richmond Heights; Peter P. Rettig, Willoughby, both of Ohio

[73] Assignee: The Ajax Manufacturing Company, Cleveland, Ohio

[21] Appl. No.: 896,005

[22] Filed: Apr. 13, 1978

Related U.S. Application Data

[63] Continuation of Ser. No. 622,080, Oct. 14, 1975, abandoned.

[51] Int. Cl.[2] ..... B21D 43/05; B21D 43/06; B21D 43/10; B21D 45/06

[52] U.S. Cl. ..... 72/420; 72/422; 10/12 T; 10/76 T; 279/51; 72/405

[58] Field of Search ..... 72/421, 419, 405, 420, 72/422; 279/4, 51, 5, 41 R; 214/1 BB; 10/12 T, 76 T

[56] References Cited

U.S. PATENT DOCUMENTS

| | | | |
|---|---|---|---|
| 1,318,378 | 10/1919 | Hansen | 72/421 |
| 1,727,820 | 9/1929 | Greve | 72/405 |
| 2,371,063 | 3/1945 | Morison | 72/421 |
| 2,856,806 | 10/1958 | Hercik | 72/421 |
| 2,994,992 | 8/1961 | Thompson | 279/4 |
| 3,210,088 | 10/1965 | Williamson et al. | 279/51 |

FOREIGN PATENT DOCUMENTS

| | | | |
|---|---|---|---|
| 2057515 | 6/1971 | Fed. Rep. of Germany | 72/422 |
| 1185032 | 3/1970 | United Kingdom | 72/422 |

*Primary Examiner*—Francis S. Husar
*Assistant Examiner*—D. M. Gurley
*Attorney, Agent, or Firm*—Maky, Renner, Otto & Boisselle

[57] ABSTRACT

A transfer mechanism for horizontal forging machines, particularly useful for transferring relatively large workpieces which incorporate a porter bar, such transfer mechanism comprising a collet and a collet holder, both being mounted for in and out movement on a movable transfer plate, the collet being movable toward the workpiece with respect to the holder to grip the workpiece therein, with the transfer plate being supported for swivel movement on an axis to swing the collet and thus the workpiece to clear the stationary dies of the forging press, the transfer plate also being movable to index the workpiece gripped by the collet from a loading station through successive forging die stations.

20 Claims, 7 Drawing Figures

FORGING MACHINE TRANSFER FOR HEAVY WORKPIECES

This is a continuation of application Ser. No. 622,080, filed Oct. 14, 1975, now abandoned.

This invention relates generally as indicated to a forging machine transfer for heavy workpieces and more particularly for a collet type transfer for heavy workpieces such as those incorporating a porter bar with the collet gripping the porter bar and moving the workpiece from the loading station through successive forging die stations.

For heavy workpieces such as oil well tool joints, heated rectangular billets are normally provided with a porter bar which sticks out from one end of the billet. Such heavy billets are then grasped by tongs and may be manually fed or transferred through successive piercing, upsetting and punchout forging operations. Even when the tongs are supported by a hoist, considerable manual labor is required. Moreover, with a tong transfer, it is difficult to properly position the workpiece in a position to be gripped by the stationary and movable gripping dies, but also difficult to rotate the workpiece axially from one die station to another in order to prevent the formation of excessive flash.

With the present invention, there is provided a transfer mechanism which will firmly grip the workpiece, either directly or through the porter bar, and which will transfer the workpiece through the die stations also rotating the workpiece between die stations as required.

It is accordingly a principal object of the present invention to provide a forging machine transfer for heavy workpieces which eliminates the heavy manual labor normally required.

It is another principal object of the present invention to provide a transfer mechanism for a forging machine utilizing a collet which will firmly grip the workpiece.

Still another important object of the present invention is the provision of a transfer mechanism for forging machines which will rotate the workpiece axially between successive die stations.

Still another object is the provision of a collet type transfer mechanism for forging machines in which the work gripping collet may be swung slightly about an axis to remove the workpiece from the stationary dies of the machine and also rotated axially between die stations.

Yet another object is the provision of a collet type transfer mechanism for horizontal forging machines wherein the work gripping collet in either its open or closed condition may be moved axially in and out of the throat of the machine.

A further object of the present invention is the provision of a relatively inexpensive transfer mechanism for heavy workpieces for horizontal forging machines which may be fully automated thus removing all manual labor in the transfer of heavy workpieces.

Other objects and advantages of the present invention will become apparent as the following description proceeds.

To the accomplishment of the foregoing and related ends, the invention then comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

In said annexed drawings:

FIG. 6 is an end elevation of the collet and holder taken on the line 6—6 of FIG. 3.

Figure 1:
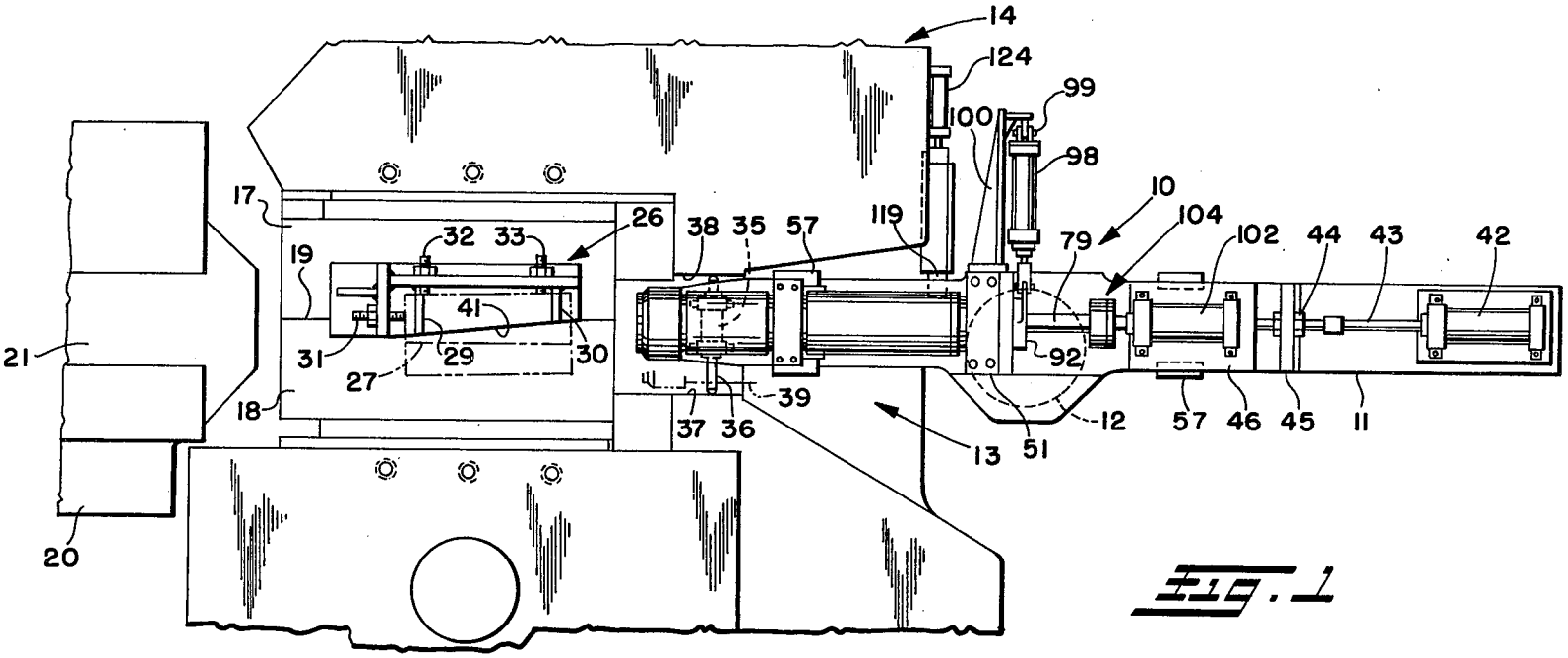
FIG. 1 is a top plan view of a transfer mechanism of the present invention showing the same positioned in the throat of a horizontal forging machine with the latter broken away.
Figure 2:
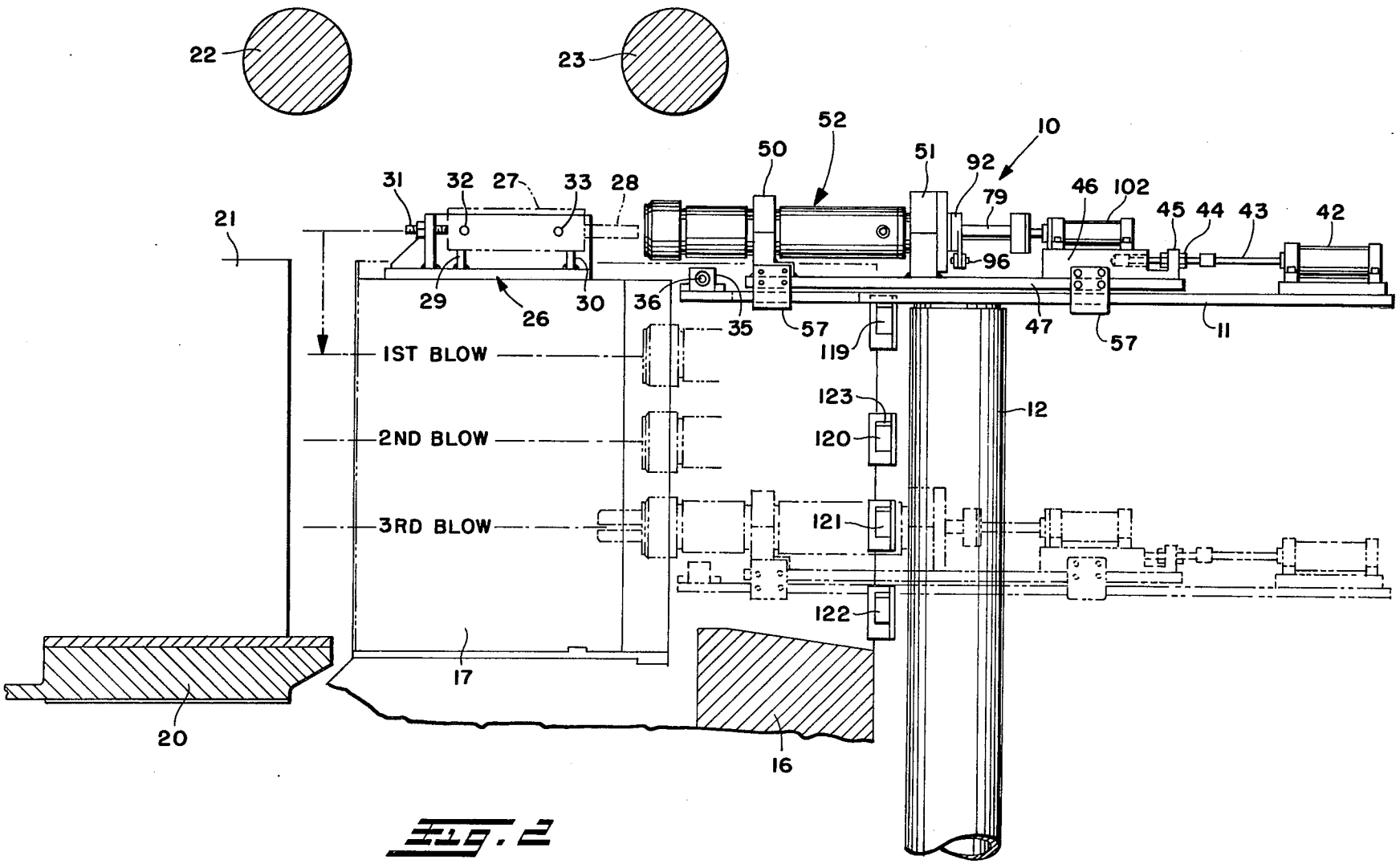
FIG. 2 is a side elevation of the transfer mechanism with parts of the forging machine shown in section and also showing the successive transfer positions of the transfer mechanism in phantom lines.
Figure 3:
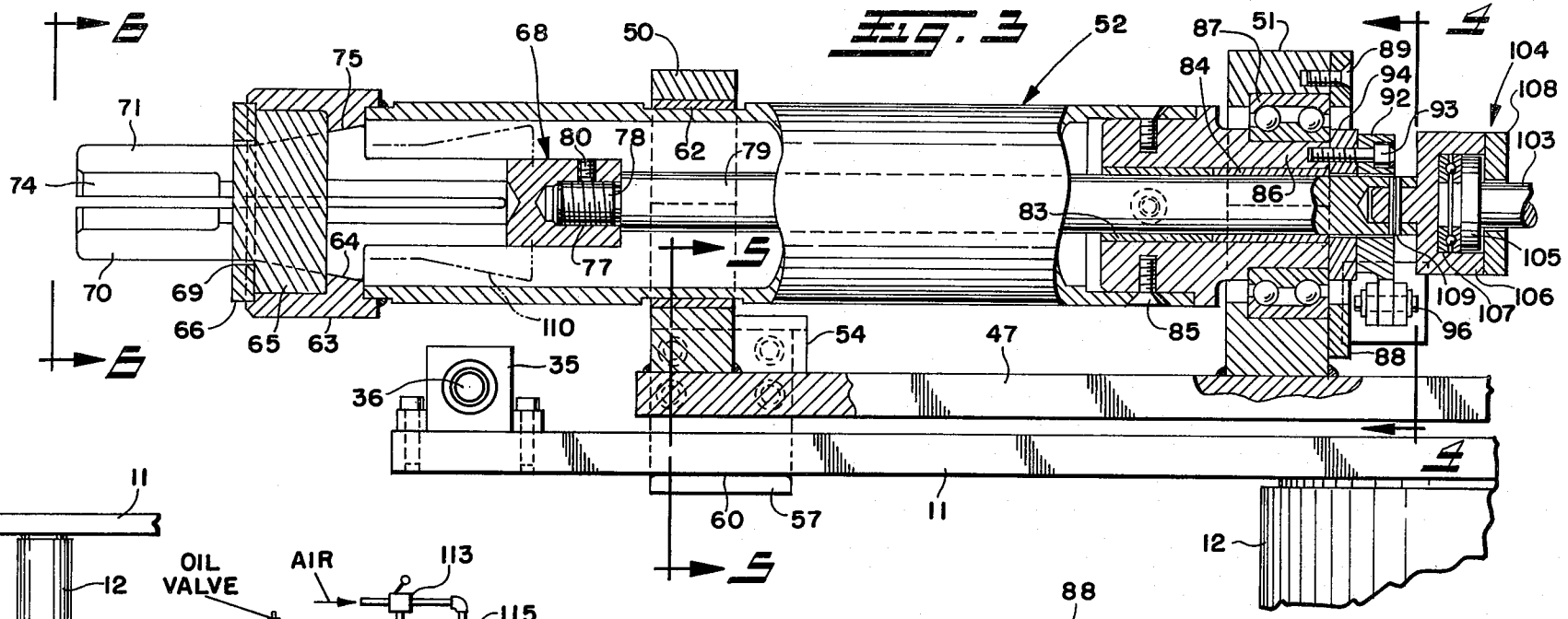

Referring now to the annexed drawings and more particularly to FIGS. 1 and 2, the transfer mechanism is shown generally at 10 and is mounted on an adaptor plate 11 fixed to the top of piston 12 of a relatively large vertically extending hydraulic piston-cylinder assembly. The adaptor plate 11 is elongated and projects into the throat 13 of the horizontal forging machine shown generally at 14.

The forging machine comprises a main frame 16 supporting a fixed gripping die 17 and a horizontally movable gripping die 18, which when closed, mate at the parting line 19. Such dies have, in conventional manner, a series of vertically spaced mating gripping die cavities. A horizontally movable header slide 20 supports a plurality of vertically spaced forging dies 21 which strike the workpiece as the header slide moves forward or to the right as seen in FIGS. 1 and 2 when the gripping dies have closed upon the workpiece. Relatively large cross tie rods 22 and 23 of the machine are shown in FIG. 2. The illustrated forging machine may, for example, be a 10" forging machine of the type manufactured by The Ajax Manufacturing Company of Cleveland, Ohio. Reference may be had to Kull et al, U.S. Pat. No. 3,412,595 and Kull U.S. Pat. No. 3,124,816 for more detailed illustrations of horizontal forging machines, although somewhat smaller than the forging machine illustrated.

The top of the stationary die 17 is provided with a load station cradle indicated at 26 on which the heated billet 27 is positioned from the porter bar press. The porter bar press simply inserts a porter bar 28 in the end of the billet projecting axially therefrom. The cradle 26 is provided with two bottom support plates 29 and 30 on which the billet rests, as well as an end adjustable gauge 31 and two side adjustable gauges 32 and 33. In this manner, the billet, with the porter bar therein, is accurately positioned in the load station for gripping by the transfer mechanism.

Referring now to the transfer mechanism 10, it will be seen that the forward end of the adaptor plate 11 is provided with a transverse piston-cylinder assembly 35, the rod 36 of which projects through both ends of the cylinder. The ends of such rod are slightly rounded and bear against the inside walls 37 and 38 of the throat 13 of the forging machine 14. Actuation of the piston-cylinder assembly 35 will cause the transfer mechanism to move from the full line position shown in FIG. 1 to the phantom line position indicated at 39 pivoting the entire mechanism slightly about the vertical axis of the rod 12. This slight pivoting movement moves the billet 27 after it has been gripped by the transfer mechanism to the phantom line position 40 clearing the load station cradle as well as the fixed dies. The bottom of the cradle may be cut at the slight angle indicated at 41 to clear the billet vertically in the position 40.

It can be seen in FIG. 1 that the vertical axis of piston 12 about which the entire mechanism pivots is horizontally outwardly offset in the direction of the movable gripping die 18 relative to the vertical plane of the stationary gripping die face or parting line 19 and to the horizontal longitudinal axis of the collet 68 which collet axis preferably is in the vertical plane of the stationary gripping die face. In other words, the longitudinal axis of the collet does not intersect the vertical axis of the position.

The rear of the adaptor plate 11 has secured thereto a piston-cylinder assembly 42, the rod 43 of which is adjustably connected at 44 to upwardly extending projection 45 on cylinder support 46 which is in turn secured to movable transfer plate 47.

Also mounted on the transfer plate 47 are two split pillow blocks 50 and 51 in and between which is journalled cylindrical collet holder 52.

Figure 3:
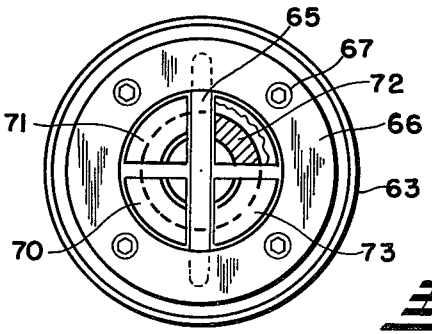
FIG. 3 is an enlarged elevation partially broken away and in section of the collet and collet holder of the present invention.
Figure 5:
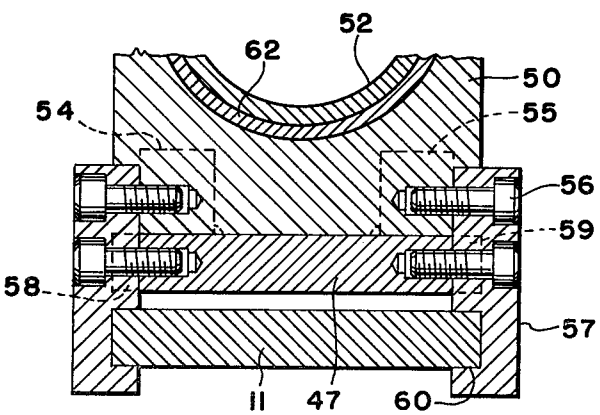
FIG. 5 is a fragmentary vertical section taken substantially on the line 5—5 of FIG. 3 illustrating the mounting of the collet holder for movement in and out.

With additional reference to Figs. 3 and 5, it will be seen that there are two blocks 54 and 55 secured to the transfer plate 47 immediately behind the pillow block 50 to accommodate one of four fasteners 56 for each depending bronze gib plates 57. The front opposed depending gib plates 57 are secured by the two lower fasteners in opposed recesses 58 and 59 in the transfer plate 47 and by the two upper fasteners in the pillow block 50 and the additional blocks 54 and 55, respectively.

The two rear gib plates 57 are also secured by four fasteners, the lower two being in recesses in the transfer plate 47 while the upper two secure the gib plates to the cylinder support 46. As seen in FIG. 5, the lower ends of the gib plates are provided with facing channels 60 confining the edges of the adaptor plate 11 thus supporting the transfer plate 47 for reciprocating movement on the adaptor plate by extension and retraction of the piston-cylinder assembly 42. Referring now more particularly to FIG. 3, it will be seen that the collet holder 52 is in the form of a cylinder which is journalled in the pillow block 50 by means of a heat resistant bronze bushing 62. Secured to the outer end of the cylinder 52 is a nosepiece 63, the interior of which is tapered as indicated at 64. A transverse stripper bar 65 extends diammetrically across the nosepiece and is held in place by a circular plate 66, secured by fasteners 67 to the nosepiece, as seen more clearly in FIG. 6.

In its extended, contracted condition, the collet 68 projects through the aperture 69 in the plate 66 as seen in FIG. 3. The collet 68 is of the spring pushout type made of tool steel which is heat treated to a spring temper. The collet comprises four fingers 70, 71, 72 and 73, two of which project through the aperture 69 on each side of the stripper bar 65. Such fingers at their outer ends are each provided with interior circular recesses seen at 74 in which the porter bar is received. The exterior of each finger is provided with a tapered shoulder 75, such shoulder collaborating with the tapered interior 64 of the nosepiece to contract and expand the collet as it is moved axially within the nosepiece. The collet is drilled and cut from a solid piece of tool steel and the rear end of the collet is drilled and tapped as indicated at 77 to provide a threaded connection with the threaded end 78 of collet actuating rod 79. A set screw 80 may be employed to maintain the collet and actuating rod 79 against relative rotation.

The opposite end of the collet rod 79 projects through bronze bushings 82 and 83 in cylindrical end block 84 removably secured by the fasteners 85 to the cylinder 52. The end block includes an axial projection 86 which is journalled in the pillow block 51 by the illustrated radial and thrust ball bearing 87. The bearing is held in place by keeper ring 88 secured to the pillow block 51 by the fasteners 89.

In order to oscillate the collet 90° about its axis, a crank plate 92 is secured to the end block projection 86 by suitable fasteners 93, such fasteners also projecting through interior bearing keeper plate 94.

Figure 4:
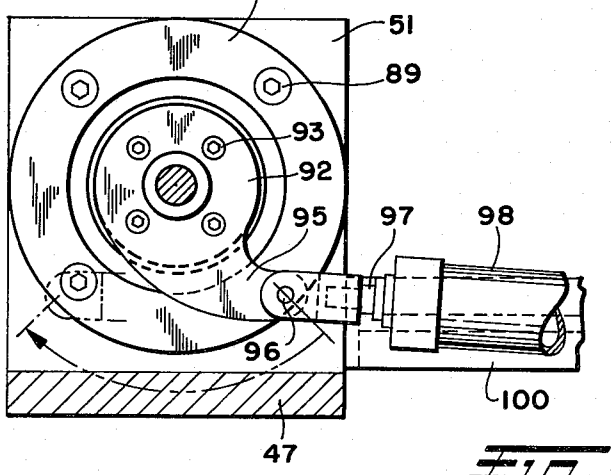
FIG. 4 is a fragmentary vertical section taken substantially on the line 4—4 of FIG. 3 illustrating the mechanism for axially pivoting the collet and collet holder.

As seen in FIG. 4, the crank plate 92 includes an arm 95 pivotally connected at 96 to the rod 97 of piston-cylinder assembly 98. The blind end of the piston-cylinder assembly 98 is pivotally mounted at 99 on bracket 100 secured to and projecting laterally from the pillow block 51, as seen perhaps more clearly in FIG. 1. Extension of the piston-cylinder assembly causes the pivot 96 to move around the 90° arc indicated at 101 in FIG. 4 thus pivoting the collet holder and the collet 90°. Retraction of the piston-cylinder assembly will return the crank plate 92 and thus the collet holder and collet to the full line position seen in FIG. 4.

Axial movement of the collet rod 79 is obtained by piston-cylinder assembly 102 mounted on the support 46. Such cylinder assembly is seen more clearly in FIGS. 1 and 2. The rod 103 of such cylinder assembly is connected to the collet rod 79 by rotational coupling 104. Such rotational coupling comprises a cylindrical flat bead 105 on the rod 103 confined in cylindrical housing 106 between thrust bearing 107 and removable ring 108. An axial projection on the housing 106 projects into a recess on the end of the collet rod 79 and is connected thereto by pin 109. In the illustrated embodiment, approximately a 6" travel of the collet rod will move the same from its retracted, released position, seen in FIG. 3 in phantom lines at 110, to its extended contracted position seen in full lines in FIG. 3. It is noted that the collet is shown in its retracted position in FIGS. 1 and 2. The rotational coupling 104 permits the collet to be rotated 90° between die stations while gripping the workpiece.

Figure 7:
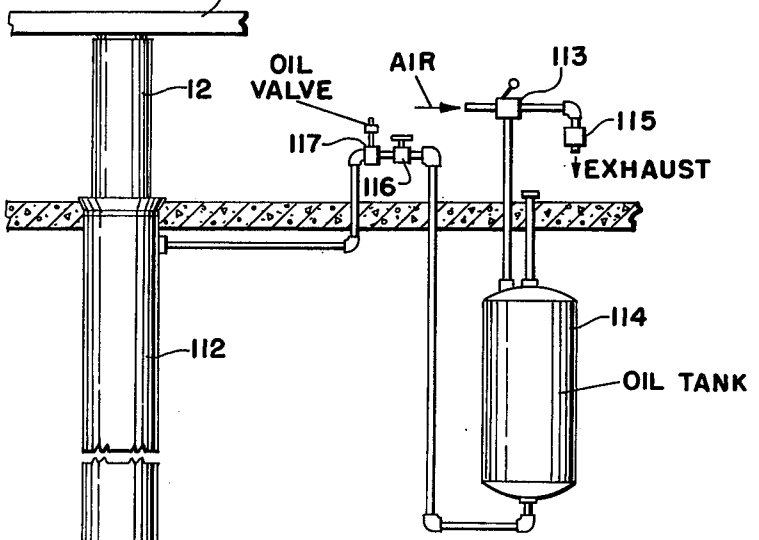
FIG. 7 is a schematic elevation of the air-over-oil system for moving the transfer mechanism vertically.

Referring now to FIG. 7, vertical movement of the transfer mechanism longitudinally along the vertical axis of the rod 12 is obtained by an air-over-oil piston-cylinder assembly 112 supporting the rod 12 in turn supporting the adaptor plate 11. Control of the vertical movement of the rod 12 is obtained by air valve 113 supplying air to air-over-oil tank 114 in one position, and in another position, exhaustingair from the tank to exhaust 115. Oil passes from the tank through flow-rate valve 116 and shut-off valve 117 which are normally not operated during the cycle of the transfer mechanism. The rod 12 is preferably a hollow tubular member which freely rotates in the cylinder 112 thus permitting the relatively small piston-cylinder assembly 35 to pivot the transfer mechanism about the vertical axis of the rod 12.

In order precisely to control the vertical elvation of the transfer mechanism at the various stations of the forging machine, each station is provided with a retractable positive stop gauge as seen at 119, 120, 121 and 122 in FIG. 2. Each stop includes a top surface 123 adapted to underly the adaptor plate 11 when the stop gauge is extended. Each stop is actuated by a respective piston-cylinder assembly 124 as seen in FIG. 1.

To change or replace collets, since different size workpieces may require different size or configuration of collets, the top of the pillow block 50 is removed and the fasterners 85 are also removed to permit the cylindrical holder 52 to be withdrawn from the actuating rod 79. Removal of the set screw 80 and the removal of the collet from the rod is then readily accomplished. The entire collet and holder assembly may be removed by removing the tops of the pillow blocks 50 and 51, disconnecting the pin 109 and removing the crank plate 92 as well as the keeper plate 88.

OPERATION

Although not shown, it will be appreciated by one skilled in the art that the various piston-cylinder assemblies may be operated in sequence with the forging press to accomplish the cycle of operation described below. With the machine at a normal rest position, in which the header slide is back and the gripping dies are open, a heated billet from the porter bar press is deposited in the load station cradle 26 on the top of the stationary die 17. The gauges ensure that the billet is properly positioned to be picked up by the transfer mechanism.

Before the tansfer cycle commences, an adjustment is made at 44 to ensure that the collet will be in the proper position as it moves forward to grip the workpiece when the transfer plate is indexed forward or toward the workpiece. From its retracted position, the cylinder assembly 42 is extended moving the collet holder forward to the position shown in FIG. 1. The transfer cycle is energized and the collet now moves axially out of the holder by the extension of the piston-cylinder assembly 102 and locks on the porter bar 28. The piston-cylinder assembly 35 is now actuated to cause the adaptor plate and thus the entire transfer assembly to pivot slightly about the vertical axis of the piston 12 swinging the billet out from the load cradle to clear the load cradle and the stationary die. The stop 119 is retracted and the valve 113 is actuated causing the piston and thus the transfer mechanism holding the billet to descend until engagement with the stop 120. At this point, the piston-cylinder assembly 35 is again actuated causing the transfer mechanism to swing the billet back into the stationary die at the first station. At this point, the machine is tripped and a single forging cycle commences forging the billet in the first die station. This is accomplished by the movable die 18 closing on the stationary die 17 and with the header slide moving forward to strike the billet thus gripped. As the header slide retracts, the movable gripping die also opens moving away from the stationary die 17 or downwardly as viewed from the top in Fig. 1.

When the gripping dies are open, the stop 120 now retracts, the piston-cylinder assembly 35 is actuated to swing the workpiece out of the die cavity of the stationary die and the valve 113 is again actuated further to lower the transfer mechanism and thus the workpiece until contact is made with stop 121. At this point, the piston-cylinder assembly 98 may be extended to rotate the workpiece about its axis 90°. The piston-cylinder assembly 35 is again actuated swinging the workpiece into the cavity for the second blow and the machine is again tripped on a single cycle. The same procedure is followed transferring the workpiece to the third station with the piston-cylinder assembly 98 being retracted to again rotate the workpiece 90° back to its original position.

As soon as the dies close on the part in the third station, the piston-cylinder assembly 102 is retracted to retract the collet to clear the porter bar. The stripping bar 65ensures that the workpiece doesn't come with the collet, and also acts to protect the collet in its retracted position. As soon as the collet is clear of the porter bar, the collet holder assembly is retracted by retraction of the piston-cylinder assembly 42. The final operation includes a punch-out which removes that portion of the billet to which the porter bar is secured and the retraction of the transfer mechanism provides the proper clearance.

The valve 113 is then actuated to elevate the transfer mechanism, the stops 119 through 122 are then repositioned, and the cycle is repeated.

It can now be seen that there is provided a transfer mechanism for heavy workpieces which avoids the manual labor normally required in transferring heavy workpieces through the various forging stations.

We claim:

1. A transfer mechanism for moving relatively large workpieces through the die stations of a horizontal forging machine having a stationary and movable die and forging dies, comprising: collet means for gripping a workpiece, a platform for supporting said collet means, means to index longitudinally along an axis thereof said platform while said collet means grips the workpiece to transfer the workpiece in one direction from a loading station through successive forging die stations, said platform being pivotal about such axis, and means to swing said platform about such axis for removal of the workpiece from within the confines of the stationary die, and the longitudinal axis of said collet means not intersecting the axisof said means to index.

2. A transfer mechanism as set forth in claim 1, wherein said means to index comprises a vertically extending index piston-cylinder assembly supporting said platform.

3. A transfer mechanism as set forth in claim 2, wherein said means to swing said platform comprises a swing piston-cylinder assembly connected to said platform radially of such axis of said index piston-cylinder assembly.

4. A transfer mechanism as set forth in claim 3 for a forging machine having a throat, wherein said platform has a portion thereof adapted to project into the throat of the forging machine, and said swing piston-cylinder assembly is mounted on said portion and includes a rod projecting from both ends of the cylinder of said swing piston-cylinder assembly, with the rod ends each being adapted to engage one side of the throat.

5. A transfer mechanism as set forth in claim 1, wherein said collet means comprises a collet, a collet holder, and means relatively to move said collet and collet holder to close and open said collet respectively to grip and release the workpiece.

6. A transfer mechanism as set forth in claim 5, wherein said collet comprises a plurality of elongated fingers for gripping the workpiece over a substantial length of the workpiece, said fingers having an exteriorly tapered shoulder, and said collet holder comprises a cylinder having an interiorly tapered nosepiece onone end of the same, whereby movement of said collet and collet holder relative to one another causes the same to engage and disengage said exteriorly tapered shoulder with said interiorly tapered nosepiece respectively to grip and release the workpiece.

7. A transfer mechanism as set forth in claim 36, wherein said nosepiece includes a stripper bar extending diametrically thereof through said fingers of said collet to ensure that the workpiece disengages from said collet as said collet is moved relative to said collet holder, and thus relative to said stripper bar, to open said collet.

8. A transfer mechanism as set forth in claim 5, wherein said collet holder is journalled for axial rotation on said platform, and further comprising means selectively for oscillating said collet and collet holder and thus the workpiece held by said collet between successive die stations.

9. A transfer mechanism as set forth in claim 8 further comprising a collet actuating rod extending through said collet holder, and power means tomove said rod axially within said collet holder to open and close said collet.

10. A transfer mechanism as set forth in claim 9, wherein said power means comprises a piston-cylinder assembly connected to said collet actuating rod.

11. A transfer mechanism as set forth in claim 10 further comprising a rotational coupling between said piston-cylinder assembly and said collet actuating rod to permit such oscillation of said collet and collet holder.

12. A transfer mechanism as set forth in claim 10, wherein said means to oscillate said collet and collet holder comprises a crank connected to said collet holder, and a piston-cylinder assembly connected to said crank.

13. A transfer mechanism as set forth in claim 10, wherein said collet, collet holder, power means, and means to oscillate said holder are mounted asa unit on said platform for movement toward and away from the forging machine.

14. A transfer mechanism as set forth in claim 5 further comprising retractable positive stops for each die station adapted when extended to engage said platform.

15. A transfer mechanism as set forth in claim 5, wherein said collet and collet holder are mounted on said platform for movement toward and away from the forging machine.

16. A transfer mechanism as set forth in claim 5, wherein said means to index said platform comprises a vertically-extending index piston-cylinder assembly.

17. A transfer mechanism as set forth in claim 5, wherein said collet extends outwardly from said collet holder when said collet is closed.

18. A transfer mechanism as set forth in claim 17, wherein said collet holder comprises a cylinder journalled on said platform, and further comprising piston-cylinder means selectively to rotate said cylinder thus to rotate the workpiece as it is indexed between die stations to orientate the workpiece relative to the respective die stations.

19. A transfer mechanism as set forth in claim 18 further comprising a collet actuating rod extending through said collet holder, and a collet actuating piston-cylinder assembly connected to said holder by means of a rotational thrust coupling whereby said collet holder and rod may rotate while said collet grips the workpiece to orientate the workpiece relative to the respective die stations.

20. A transfer mechanism as set forth in claim 19 for a forging machine having a throat, wherein said collet and collet holder are mounted for movement on said platform toward and away from the throat of the forging machine.

* * * * *